US007737618B2

(12) United States Patent
Nam et al.

(10) Patent No.: US 7,737,618 B2
(45) Date of Patent: Jun. 15, 2010

(54) DISPLAY APPARATUS

(75) Inventors: Mun-Ho Nam, Suwon-si (KR); Seung-Hyun Son, Suwon-si (KR); Hyoung-Bin Park, Suwon-si (KR); Sang-Hun Jang, Suwon-si (KR); Gi-Young Kim, Suwon-si (KR); Sung-Soo Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 181 days.

(21) Appl. No.: 12/016,956

(22) Filed: Jan. 18, 2008

(65) Prior Publication Data

US 2008/0197763 A1 Aug. 21, 2008

(30) Foreign Application Priority Data

Feb. 16, 2007 (KR) ..... 10-2007-0016756

(51) Int. Cl.
*H01J 1/62* (2006.01)

(52) U.S. Cl. ..... 313/495; 313/309

(58) Field of Classification Search ..... 313/495, 313/309, 310, 336, 351
See application file for complete search history.

(56) References Cited

FOREIGN PATENT DOCUMENTS

KR 10-2006-0069786 6/2006

OTHER PUBLICATIONS

Korean patent abstracts for publication No. 1020060069786 A, dated Jun. 22, 2006 in the name of Hidekazu Hatanaka et al.

*Primary Examiner*—Vip Patel
(74) *Attorney, Agent, or Firm*—Christie, Parker & Hale, LLP

(57) ABSTRACT

A display apparatus is having a first substrate and a second substrate facing the first substrate. An electrode is located on an inner surface of the first substrate or an inner surface of the second substrate. An electron emitter is located on the electrode. A barrier rib structure is disposed between the first substrate and the second substrate to define a sealed inner space therebetween. The barrier rib structure is comprised of a conductive material. A gas is located between the first substrate and the second substrate.

20 Claims, 3 Drawing Sheets

DISPLAY APPARATUS

CROSS-REFERENCE TO RELATED PATENT APPLICATION

This application claims priority to and the benefit of Korean Patent Application No. 10-2007-0016756, filed on Feb. 16, 2007, in the Korean Intellectual Property Office, the entire content of which is incorporated herein by reference.

BACKGROUND OF THE INVENTION

1. Field of the Invention

The present invention relates to a display apparatus, and, more particularly, to a display apparatus having a structure in which electron beams proceed toward sides of a sealed inner space between substrates.

2. Description of the Related Art

A field emission display (FED) apparatus is a flat panel display apparatus in which cathodoluminescent light is generated by colliding electron rays such as cathode tube rays with a phosphor layer in a field emitter array (FEA) matrix that is a cold cathode electron source. In the case of a FED apparatus, a cathode luminescence (CL) phosphor layer is used, and the light emission efficiency thereof is low.

A PDP is a display device that displays desired numbers, letters, or images using visible light emitted from phosphor layers which are excited by ultraviolet rays generated during a gas discharge initiated by applying a direct or alternate current voltage to a plurality of discharge electrodes formed on a plurality of substrates after a discharge gas is sealed between the plurality of substrates.

FIG. 1 is a cross-sectional view of a conventional three-electrode surface discharge type plasma display panel 100.

Referring to FIG. 1, the conventional three-electrode surface discharge type plasma display panel 100 includes a first substrate 101, a second substrate 102, sustain discharge electrode pairs 105 each having an X electrode 103 and a Y electrode 104 formed on an inner surface of the first substrate 101, a first dielectric layer 106 that buries (or covers) the sustain discharge electrode pairs 105, a protective film layer 107 formed on a surface of the first dielectric layer 106, a plurality of address electrodes 108 formed on an inner surface of the second substrate 102 and extending in a direction crossing the sustain discharge electrode pairs 105, a second dielectric layer 109 that buries (or covers) the address electrodes 108, a barrier rib structure 110 formed between the first and second substrates 101 and 102, and red, green, and blue phosphor layers 111 formed (or defined) in discharge cells. An inner space formed by the combination of the first substrate 101 and the second substrate 102 is a discharge space and a discharge gas is filled in the discharge space.

The conventional three-electrode surface discharge type plasma display panel 100 having the above structure can be readily fabricated using a thick film forming technique such as a printing process. However, due to process limits, it is difficult to display images of high quality and high resolution.

In the conventional three-electrode surface discharge type plasma display panel 100, visible light is obtained through a series of processes in which electrons are continuously produced through discharges, and accelerated electrons collide with neutral particles to generate excited particles that emit vacuum ultraviolet rays, and the vacuum ultraviolet rays excite the phosphor layer 111 to emit visible light.

However, ions that are not advantageous for generating light are also produced in the above processes, and the energy utilized to accelerate these ions consume more than half of the total energy used. Therefore, due to the unnecessary energy consumption, which lowers energy efficiency, the conventional three-electrode surface discharge type plasma display panel 100 has a low light emission efficiency.

SUMMARY OF THE INVENTION

Aspects of embodiments of the present invention are directed toward a display apparatus that can increase light emission efficiency of a field emission display (FED) apparatus, and discharge efficiency of a plasma display panel.

An aspect of an embodiment of the present invention is directed toward a display apparatus that can increase efficiency of gas excitation when visible light is generated from a light emitting layer by exciting a gas using electrons emitted from an electron emitter.

A display apparatus according to an exemplary embodiment of the present invention is provided to have a first substrate and a second substrate facing the first substrate. An electrode is on a surface of the first substrate facing the second substrate or on a surface of the second substrate facing the first substrate. An electron emitter is on the electrode. A barrier rib structure is disposed between the first substrate and the second substrate to define a sealed inner space therebetween, the barrier rib structure comprising a conductive material. A gas is between the first substrate and the second substrate.

In one embodiment of the present invention, the first substrate is a transparent substrate for allowing visible light to pass therethrough, the electrode is a cathode disposed on the surface of the second substrate facing the first substrate, and the barrier rib structure is an anode.

In one embodiment of the present invention, electrons emitted from the electron emitter are directed toward the barrier rib structure at side portions of the sealed inner space defined by the first substrate, the second substrate, and the barrier rib structure.

In one embodiment of the present invention, a light emitting layer is on the surface of the first substrate facing the second substrate.

In one embodiment of the present invention, the first substrate is a transparent substrate for allowing visible light to pass therethrough, the electrode is a cathode disposed on the surface of the first substrate facing the second substrate, and the barrier rib structure is an anode.

In one embodiment of the present invention, a light emitting layer is on the surface of the second substrate facing the first substrate.

In one embodiment of the present invention, the light emitting layer is disposed such that visible light generated from the light emitting layer is emitted to the outside through the electron emitter.

In one embodiment of the present invention, the electron emitter comprises a material selected from oxidized porous silicon, oxidized porous amorphous silicon, boron nitride bamboo shoot, and combinations thereof.

In one embodiment of the present invention, the gas is selected from the group consisting of $N_2$, heavy hydrogen, $CO_2$, $H_2$, CO, Kr, air, Xe, He, Ar, Ne, and combinations thereof.

A display apparatus according to another exemplary embodiment is provided to have a first substrate for allowing visible light to pass therethrough and a second substrate facing the first substrate. A first electrode is on a surface of the first substrate facing the second substrate or on a surface of the second substrate facing the first substrate. An electron emitter is on the first electrode. A barrier rib structure is disposed between the first substrate and the second substrate to define a sealed inner space therebetween. A second electrode is on a surface of the barrier rib structure. A gas is between the first substrate and the second substrate.

In one embodiment of the present invention, the first electrode is a cathode on the surface of the second substrate facing the first substrate, and the second electrode is an anode.

In one embodiment of the present invention, the second electrode is coated along side surfaces of the barrier rib structure facing the sealed inner space defined by the first substrate, the second substrate, and the barrier rib structure.

In one embodiment of the present invention, electrons emitted from the electron emitter are directed toward side portions of the sealed inner space where the barrier rib structure is disposed.

In one embodiment of the present invention, a light emitting layer is on the surface of the first substrate facing the second substrate.

In one embodiment of the present invention, the first electrode is a cathode on the surface of the first substrate facing the second substrate, and the second electrode is an anode.

In one embodiment of the present invention, the second electrode is coated along a surface of the barrier rib structure facing the second substrate.

In one embodiment of the present invention, the light emitting layer is disposed such that visible light generated from the light emitting layer is emitted to the outside through the electron emitter.

In one embodiment of the present invention, the electron emitter comprises a material selected from oxidized porous silicon, oxidized porous amorphous silicon, boron nitride bamboo shoot, or combinations thereof.

In one embodiment of the present invention, the gas is selected from the group consisting of $N_2$, heavy hydrogen, $CO_2$, $H_2$, CO, Kr, air, Xe, He, Ar, Ne, and combinations thereof.

In one embodiment of the present invention, the gas is selected from the group consisting of $N_2$, heavy hydrogen, $CO_2$, $H_2$, CO, Kr, air, and combinations thereof.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
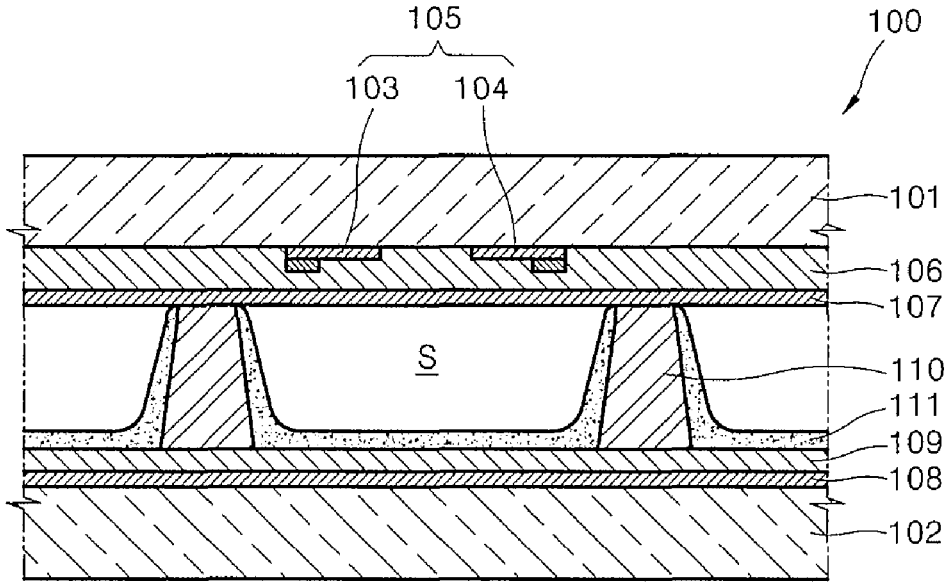
FIG. 1 (PRIOR ART)
FIG. 1 is a cross-sectional view of a conventional three-electrode surface discharge type plasma display panel.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

Figure 2:
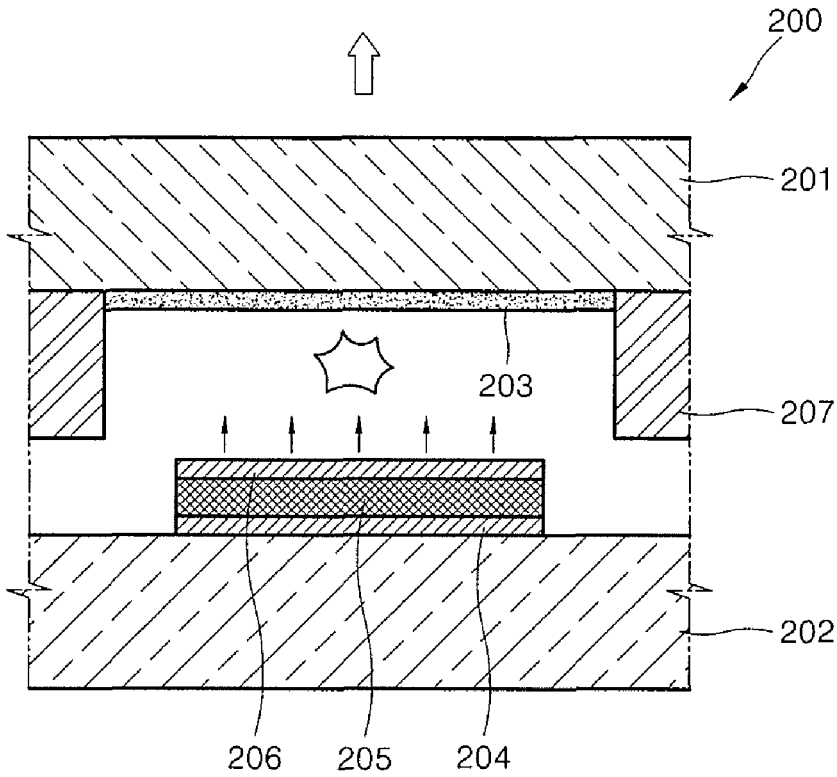
FIG. 2 is a cross-sectional view illustrating a display apparatus according to an exemplary embodiment of the present invention.

FIG. 2 is a cross-sectional view illustrating a transmissive type display apparatus 200 according to an exemplary embodiment of the present invention.

Referring to FIG. 2, the transmissive type display apparatus 200 includes a first substrate 201 and a second substrate 202 disposed parallel to the first substrate 201. Frit glass is coated along edge portions (or edges) of inner surfaces of the first substrate 201 and the second substrate 202 to form an inner sealed space.

A light emitting layer 203 is formed on an inner surface of the first substrate 201 (or formed on a surface of the first substrate 201 facing the second substrate 202). A cathode 204 is formed on an inner surface of the second substrate 202 (or formed on a surface of the second substrate 202 facing the first substrate 201). An electron emitter 205 is formed on a surface of the cathode 204. A grid electrode 206 is formed on a surface of the electron emitter 205.

A barrier rib structure 207 is formed between the first substrate 201 and the second substrate 202. An inner space defined by the combination of the first substrate 201, the second substrate 202, and the barrier rib structure 207 is filled with a gas. The gas may be a gas mixture in which Xe gas is mixed with He gas, Ar gas, and/or Ne gas.

The gas can be any suitable gas that can generate ultraviolet rays when the gas is excited by electrons emitted from the electron emitter 205. That is, besides the gas mixture that includes the Xe gas, various suitable gases, for example, $N_2$, heavy hydrogen, $CO_2$, $H_2$ gas, CO, Kr, and/or air, can be used.

In the transmissive type display apparatus 200, the barrier rib structure 207 is utilized as an anode.

The first substrate 201 and the second substrate 202 can be a transparent substrate such as a soda lime glass, a semi-transparent substrate, a reflective substrate, or a colored substrate. Since visible light must pass through the first substrate 201, the first substrate 201 may be formed of a material having high transmittance.

The light emitting layer 203 is formed in each of the sealed inner spaces defined by the barrier rib structure 207. The light emitting layer 203 is a photo luminescence (PL) phosphor layer that emits visible light using a photo luminescence mechanism. Thus, the light emitting layer 203 emits visible light due to collisions with vacuum ultraviolet rays generated by a gas excited by electrons emitted from the electron emitter 205.

The light emitting layer 203 is formed of a material having high light emission efficiency at a wavelength ranging from 140 to 180 nm, and, in one embodiment, at a wavelength of 147 nm so that the material can be excited by vacuum ultraviolet rays of wavelength of 147 nm that are generated from the Xe gas. The light emitting layer 203 includes sub-pixels of a red light emitting layer, a green light emitting layer, and a blue light emitting layer formed in the sealed inner spaces to display a color image.

The red light emitting layer may be formed of $(Y,Gd)BO_3$; $Eu^{+3}$, the green light emitting layer may be formed of $Zn_2SiO_4:Mn^{2+}$, and the blue light emitting layer may be formed of $BaMgAl_{10}O_{17}:Eu^{2+}$. Also, the blue light emitting layer can be formed of a mixture of $CaMgSi_2O_8:Eu^{2+}$ and $CaMgSi_2O_8:Eu^{2+}$ or $BaMgAl_{10}O_{17}:Eu^{2+}$, but the present exemplary embodiment is not limited to any one of the above mixtures. Also, the light emitting layer 203 according to the present exemplary embodiment is not limited to the PL phosphor layer. That is, the light emitting layer 203 can be formed of any suitable material that can generate visible light while atoms of the material are re-stabilized after being excited by receiving vacuum ultraviolet ray energy having a particular wavelength range.

The cathode 204 is formed on an inner surface of the second substrate 202. The cathode 204 extends across a sealed inner space adjacent to the second substrate 202 in a direction of the second substrate 202. In one embodiment, the cathode 204 has a stripe shape, but the present invention is not limited thereto. The cathode 204 can be formed in a monolayer or a composite layer of a conductive film such as an indium tin oxide (ITO) film or a highly conductive metal film formed of Al and/or Ag.

The electron emitter 205 is formed on a surface of the cathode 204. The electron emitter 205 can be formed of any suitable material that can generate electron beams by accelerating electrons, and, in one embodiment, can be formed of oxidized porous silicon (OPS) and/or oxidized porous amorphous silicon (OPAS).

Alternatively, the electron emitter 205 can be formed of boron nitride bamboo shoot (BNBS). The BNBS is transparent in a visible light wavelength region of about 380 to 780 nm, and has high electron emission characteristics since the BNBS has (−) electron affinity.

The grid electrode 206 is formed on a surface of the electron emitter 205. The grid electrode 206 may be formed to a thickness of greater than 0 nm and less than 10 nm when the grid electrode 206 is employed in the transmissive type display apparatus 200 to increase electron emission efficiency.

The barrier rib structure 207 defines sealed inner spaces between the first substrate 201 and the second substrate 202 so that one of a red light emitting layer, a green light emitting layer, or a blue light emitting layer of the light emitting layer 203 can be formed in one of the sealed inner spaces to form one of the sub-pixels.

The barrier rib structure 207 is formed of a material having high conductivity such as Ag. The barrier rib structure 207 is utilized as an anode. That is, the anode is not formed on an inner surface of the first substrate 201 where the light emitting layer 203 is formed, but is located along sides of the sealed inner space. Accordingly, the transmissive type display apparatus 200 has a structure in which electrons emitted and accelerated from the electron emitter 205 are not accumulated on a surface of the light emitting layer 203, but induced towards the sides of the sealed inner space.

An operation of the transmissive type display apparatus 200 having the above structure will now be described in more detail.

First, an image signal received from the outside is transformed into a signal for displaying a desired image through an image process unit and a logic control unit, and is applied to the cathode 204, the grid electrode 206, and the barrier rib structure 207.

When a voltage is applied to the electron emitter 205, electrons emitted from the electron emitter 205 are accelerated by passing through the grid electrode 206. The accelerated electrons emitted from the electron emitter 205 can pass through the barrier rib structure 207 that is utilized as an anode and defines the sealed inner spaces.

The emitted electron beams excite a gas, and the gas generates vacuum ultraviolet rays while the gas is stabilized. The vacuum ultraviolet rays excite the light emitting layer 203 to generate visible light, and the visible light is emitted towards the first substrate 201 to display an image.

Because the barrier rib structure 207 that is utilized as an anode is separated from the light emitting layer 203, electrons are not accumulated on a surface of the light emitting layer 203. Accordingly, the anode does not block the region of the first substrate 201 through which visible light transmits, and thereby a reduction of brightness of the transmissive type display apparatus 200 is prevented (or reduced).

Figure 3:
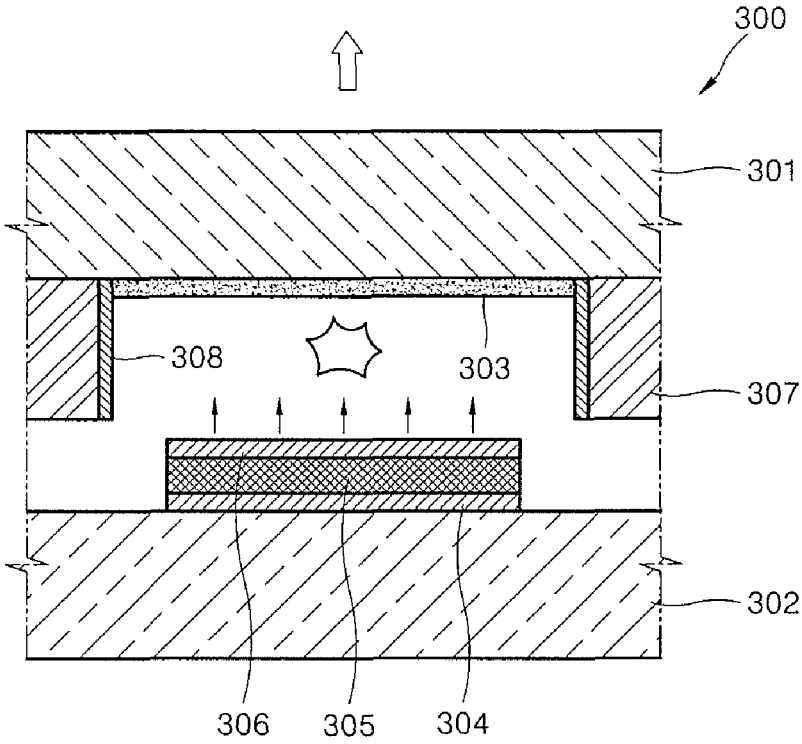
FIG. 3 is a cross-sectional view illustrating a display apparatus according to another exemplary embodiment of the present invention.

FIG. 3 is a cross-sectional view illustrating a transmissive type display apparatus 300 according to another exemplary embodiment of the present invention.

Referring to FIG. 3, the transmissive type display apparatus 300 includes a first substrate 301 and a second substrate 302 disposed in parallel to the first substrate 201. The first substrate 301 may be a substrate having high transmittance such as a soda lime glass since visible light passes through the first substrate 301.

A light emitting layer 303 is formed on an inner surface of the first substrate 301. A cathode 304 is patterned on an inner surface of the second substrate 302. An electron emitter 305 is formed on a surface of the cathode 304, and a grid electrode 306 is formed on a surface of the electron emitter 305. A barrier rib structure 307 is formed between the first substrate 301 and the second substrate 302, and a sealed inner space defined by the first substrate 301, the second substrate 302, and the barrier rib structure 307 is filled with a gas.

The light emitting layer 303 is formed in a sealed space defined by the barrier rib structure 307. The light emitting layer 303 includes red, green, and blue PL phosphor layers that can emit visible light when excited by vacuum ultraviolet rays generated by a gas excited by electrons emitted from the electron emitter 305. The cathode 304, the electron emitter 305, and the grid electrode 306 are sequentially patterned on the second substrate 302.

An anode 308 is formed on the barrier rib structure 307. That is, the anode 308 is deposited on side surfaces of the barrier rib structure 307 that contacts (or faces) the sealed inner space. Since the anode 308 is not formed on the first substrate 301 on which the light emitting layer 303 is formed, but formed along side surfaces of the sealed inner space, electron beams accelerated from the electron emitter 305 are not accumulated on a surface of the light emitting layer 303, but can pass through the anode 308. Accordingly, since the anode 308 is not positioned on an area that blocks the progress of visible light, a reduction of brightness is prevented (or reduced).

Figure 4:
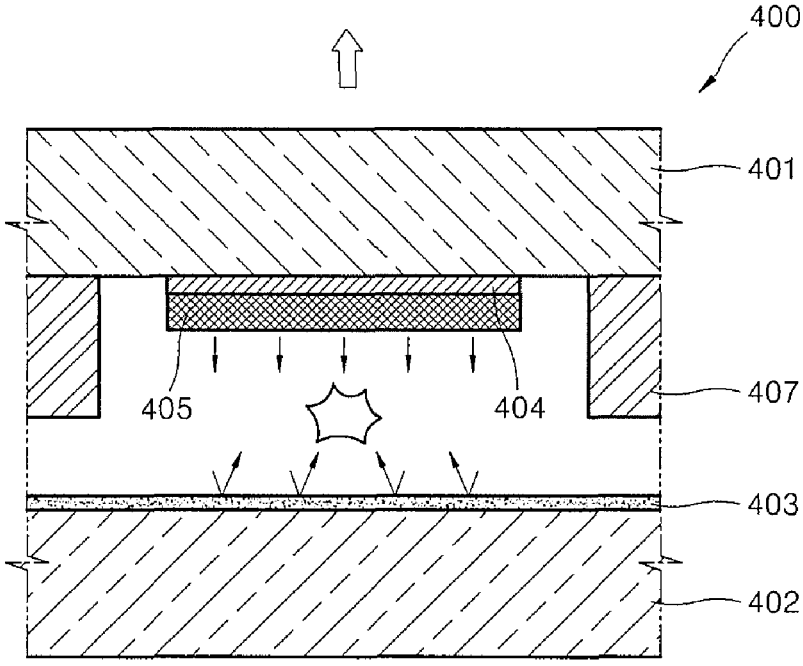
FIG. 4 is a cross-sectional view illustrating a display apparatus according to yet another exemplary embodiment of the present invention.

FIG. 4 is a cross-sectional view illustrating a transmissive type display apparatus 400 according to another exemplary embodiment of the present invention.

Referring to FIG. 4, the transmissive type display apparatus 400 includes a first substrate 401 and a second substrate 402 disposed in parallel to the first substrate 201. Visible light passes through the first substrate 401. A barrier rib structure 407 is formed between the first substrate 401 and the second substrate 402.

A light emitting layer 403 is formed on an inner surface of the second substrate 402. The light emitting layer 403 may be a PL phosphor layer that can emit visible light using a gas excited by electrons. The light emitting layer 403 includes red, green, and blue light emitting layers formed in sealed inner spaces defined by the barrier rib structure 407.

A cathode 404 is patterned on a surface of the first substrate 401. An electron emitter 405 is patterned on a surface of the cathode 404. The electron emitter 405 is formed of a material that generates electron beams by accelerating electrons, and may be formed of oxidized porous silicon, oxidized porous amorphous silicon, and/or boron nitride bamboo shoot (BNBS).

The barrier rib structure 407 is formed of a highly conductive material such as Ag so that the barrier rib structure 407 can be utilized as an anode. Since the barrier rib structure 407 is formed of a conductive material, the barrier rib structure 407 can prevent (or reduce) electrons emitted from the electron emitter 405 from being accumulated on a surface of the light emitting layer 403. Further, brightness can be increased by increasing the thickness of the light emitting layer 403. Also, the processes for forming the barrier rib structure 407 and the anode can be combined in one process, thereby simplifying the manufacturing process for forming the transmissive type display apparatus 400.

Because the anode is located on side surfaces of the sealed inner space, electron beams can be induced towards the side surfaces of the sealed inner space. Also, the transmissive type display apparatus 400 has a reflective type structure in which visible light generated from the light emitting layer 403 is emitted to the outside through the electron emitter 405 and the first substrate 401.

Figure 5:
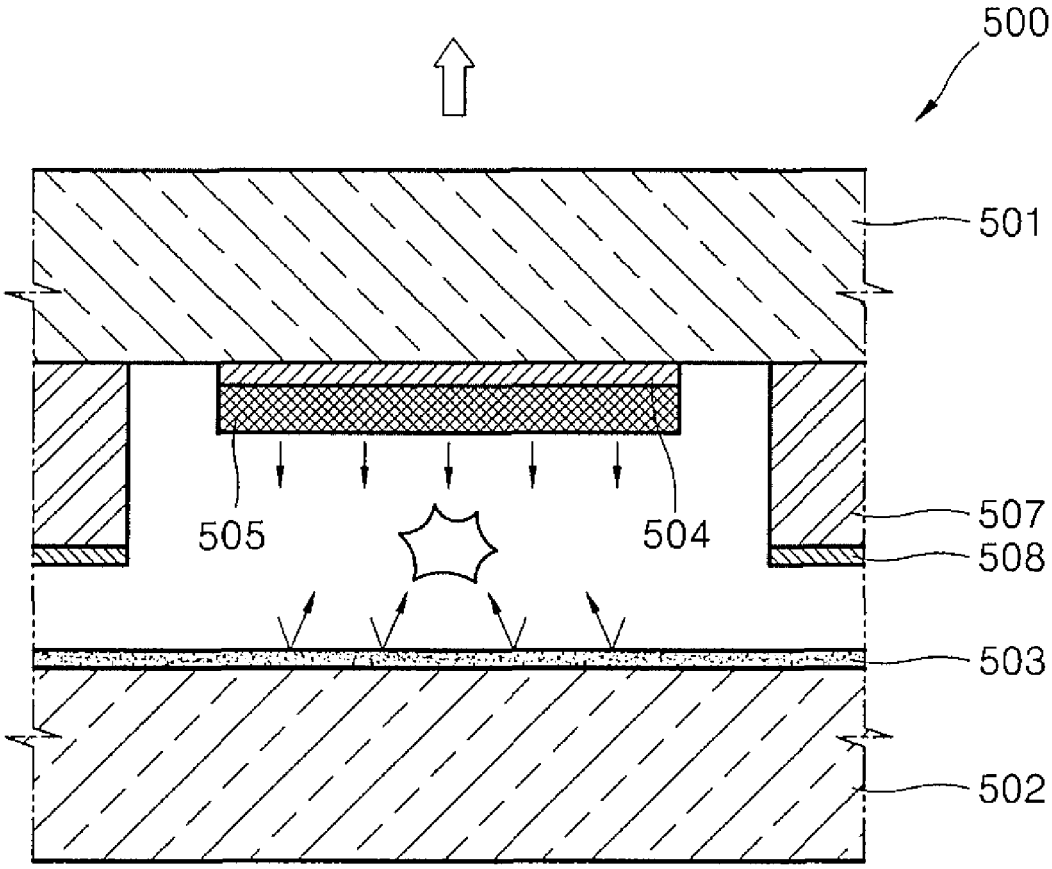
FIG. 5 is a cross-sectional view illustrating a display apparatus according to yet another exemplary embodiment of the present invention.

FIG. 5 is a cross-sectional view illustrating a transmissive type display apparatus 500 according to another exemplary embodiment of the present invention.

Referring to FIG. 5, the transmissive type display apparatus 500 includes a first substrate 501 and a second substrate 502 disposed in parallel to the first substrate 201. Visible light passes through the first substrate 501. A barrier rib structure 507 is formed between the first substrate 501 and the second substrate 502.

A light emitting layer 503 is patterned on an inner surface of the second substrate 502. The light emitting layer 503 is a PL phosphor layer that emits visible light by a photo luminescence mechanism. The light emitting layer 503 is not limited to the PL phosphor layer, but can be formed of any suitable material that can generate visible light when atoms of the material are re-stabilized after the atoms of the material receive vacuum ultraviolet ray energy having a particular wavelength range. The light emitting layer 503 includes red, green, and blue light emitting layers formed in sealed inner spaces defined by the combination of the first substrate 501, the second substrate 502, and a barrier rib structure 507.

A cathode 504 is patterned on an inner surface of the first substrate 501. An electron emitter 505 is formed on a surface of the cathode 504. The electron emitter 505 can be formed of any material that can generate electron beams by accelerating electrons. For example, the electron emitter 505 can be formed of a material selected from oxidized porous silicon, oxidized porous amorphous silicon, or BNBS.

The barrier rib structure 507 defines a sealed inner space so that red, green and blue light emitting layers of the light emitting layer 503 can respectively form sub-unit pixels.

An anode 508 is formed on a bottom surface of the barrier rib structure 507 facing the second substrate 502. Since the anode 508 is formed between the barrier rib structure 507 and the second substrate 502, the anode 508 can prevent (or reduce) electrons accelerated from the electron emitter 505 from being accumulated on a surface of the light emitting layer 503, and brightness of the transmissive type display apparatus 500 can thereby be greatly increased by increasing the thickness of the light emitting layer 503. Also, the transmissive type display apparatus 500 has a reflective type structure in which visible light generated from the light emitting layer 503 is emitted through the electron emitter 505 and the first substrate 501.

As described above, in a transmissive type display apparatus or a reflective type display apparatus according to an exemplary embodiment of the present invention, a barrier rib structure is formed of a conductive material to operate as an anode, or electrodes are deposited on sides or a lower surface of the barrier rib structure to operate as an anode. By preventing (or reducing) the accumulation of electrons on a surface of the light emitting layer, the light emitting layer can be formed to be thick, thereby increasing brightness and light emission efficiency of the transmissive type or reflective type display apparatus. Also, the processes for forming the barrier rib structure and the electrodes can be combined into one process, thereby simplifying the manufacturing process and reducing manufacturing costs.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A display apparatus comprising:

a first substrate;

a second substrate facing the first substrate;

an electrode on a surface of the first substrate facing the second substrate or on a surface of the second substrate facing the first substrate;

an electron emitter on the electrode;

a baffler rib structure disposed between the first substrate and the second substrate to define a sealed inner space therebetween, the barrier rib structure comprising a conductive material; and a gas between the first substrate and the second substrate.

2. The display apparatus of claim 1, wherein the first substrate is a transparent substrate for allowing visible light to pass therethrough, the electrode is a cathode disposed on the surface of the second substrate facing the first substrate, and the barrier rib structure is an anode.

3. The display apparatus of claim 2, wherein electrons emitted from the electron emitter are directed toward the barrier rib structure at side portions of the sealed inner space defined by the first substrate, the second substrate, and the barrier rib structure.

4. The display apparatus of claim 1, wherein a light emitting layer is on the surface of the first substrate facing the second substrate.

5. The display apparatus of claim 1, wherein the first substrate is a transparent substrate for allowing visible light to pass therethrough, the electrode is a cathode disposed on the surface of the first substrate facing the second substrate, and the barrier rib structure is an anode.

6. The display apparatus of claim 5, wherein a light emitting layer is on the surface of the second substrate facing the first substrate.

7. The display apparatus of claim 6, wherein the light emitting layer is disposed such that visible light generated from the light emitting layer is emitted to the outside through the electron emitter.

8. The display apparatus of claim 1, wherein the electron emitter comprises a material selected from oxidized porous silicon, oxidized porous amorphous silicon, boron nitride bamboo shoot, and combinations thereof.

9. The display apparatus of claim 1, wherein the gas is selected from the group consisting of $N_2$, heavy hydrogen, $CO_2$, $H_2$, CO, Kr, Ar, Xe, He, Ar, Ne, and combinations thereof.

10. A display apparatus comprising:

a first substrate for allowing visible light to pass therethrough;

a second substrate facing the first substrate;

a first electrode on a surface of the first substrate facing the second substrate or on a surface of the second substrate facing the first substrate;

an electron emitter on the first electrode;

a barrier rib structure disposed between the first substrate and the second substrate to define a sealed inner space therebetween;

a second electrode on a surface of the barrier rib structure; and a gas between the first substrate and the second substrate.

11. The display apparatus of claim 10, wherein the first electrode is a cathode on the surface of the second substrate facing the first substrate, and the second electrode is an anode.

12. The display apparatus of claim 11, wherein the second electrode is coated along side surfaces of the barrier rib structure facing the sealed inner space defined by the first substrate, the second substrate, and the baffler rib structure.

13. The display apparatus of claim 11, wherein electrons emitted from the electron emitter are directed toward side portions of the sealed inner space where the baffler rib structure is disposed.

14. The display apparatus of claim 11, wherein a light emitting layer is on the surface of the first substrate facing the second substrate.

15. The display apparatus of claim 10, wherein the first electrode is a cathode on the surface of the first substrate facing the second substrate, and the second electrode is an anode.

16. The display apparatus of claim 15, wherein the second electrode is coated along a surface of the barrier rib structure facing the second substrate.

17. The display apparatus of claim 15, wherein the light emitting layer is disposed such that visible light generated from the light emitting layer is emitted to the outside through the electron emitter.

18. The display apparatus of claim 10, wherein the electron emitter comprises a material selected from oxidized porous silicon, oxidized porous amorphous silicon, boron nitride bamboo shoot, and combinations thereof

19. The display apparatus of claim 10, wherein the gas is selected from the group consisting of $N_2$, heavy hydrogen, $CO_2$, $H_2$, CO, Kr, air, Xe, He, Ar, Ne, and combinations thereof.

20. The display apparatus of claim 10, wherein the gas is selected from the group consisting of $N_2$, heavy hydrogen, $CO_2$, $H_2$, CO, Kr, air, and combinations thereof.

* * * * *